US005561860A

United States Patent [19]

Nguyen-Senderowicz

[11] Patent Number: 5,561,860

[45] Date of Patent: Oct. 8, 1996

[54] REVERSIBLE TWO-TONED AND/OR TWO-TEXTURED SHIRT/SWEATER WITH EXTENDED SLEEVES

[76] Inventor: Khoi M. Nguyen-Senderowicz, Berkeley Main 2000 Allston, Berkeley, Calif. 94704

[21] Appl. No.: 333,998

[22] Filed: Oct. 31, 1994

Related U.S. Application Data

[63] Continuation of Ser. No. 52,714, Apr. 26, 1993, abandoned.

[51] Int. Cl.[6] ..... A41D 1/04

[52] U.S. Cl. ..... 2/90; 2/115; 2/DIG. 2

[58] Field of Search ..... 2/90, 115, 123, 2/DIG. 2, 97, 106, 108, 113, 272, 122, 121, 243.1

[56] References Cited

U.S. PATENT DOCUMENTS

| | | | |
|---|---|---|---|
| 259,931 | 6/1882 | Simmons | 2/DIG. 2 |
| 533,994 | 2/1895 | Loewenthal | 2/108 |
| 614,068 | 11/1898 | Wetzler | 2/DIG. 2 |
| 1,054,300 | 2/1913 | Lubell | 2/106 |
| 1,371,841 | 3/1921 | Berkwits | 2/DIG. 2 |
| 1,630,838 | 5/1927 | Dryer | 2/DIG. 2 |
| 2,263,544 | 11/1941 | Rosenstein | 2/DIG. 2 |
| 2,711,539 | 6/1955 | Loscher | 2/DIG. 2 |
| 2,890,460 | 6/1959 | Levi | 2/DIG. 2 |
| 3,234,564 | 2/1966 | Chujfi | 2/DIG. 2 |
| 3,492,676 | 2/1970 | King | 2/DIG. 2 |
| 3,710,394 | 1/1973 | Trice | 2/DIG. 2 |
| 3,846,844 | 11/1974 | Graf | 2/DIG. 2 |
| 3,877,078 | 4/1975 | Tepper | 2/DIG. 2 |
| 4,472,835 | 9/1984 | Clark | 2/DIG. 2 |
| 5,054,125 | 10/1991 | Snedeker | 2/97 |
| 5,204,995 | 4/1993 | Knapp | 2/DIG. 2 |

FOREIGN PATENT DOCUMENTS

| | | | |
|---|---|---|---|
| 13572 | 10/1928 | Australia | 2/97 |
| 439356 | 6/1912 | France | 2/97 |
| 1158637 | 9/1956 | France | 2/90 |
| 1571588 | 6/1969 | France | 2/DIG. 2 |
| 2309115 | 11/1976 | France | 2/108 |
| 3635606 | 4/1988 | Germany | 2/DIG. 2 |
| 5831 | 10/1892 | Switzerland | 2/97 |
| 291489 | 6/1953 | Switzerland | 2/97 |
| 12610 | of 1895 | United Kingdom | 2/108 |
| 317293 | 8/1929 | United Kingdom | 2/97 |
| 978911 | 1/1965 | United Kingdom | 2/DIG. 2 |
| 2263225 | 7/1993 | United Kingdom | 2/108 |

*Primary Examiner*—Amy B. Vanatta

[57] ABSTRACT

An improved shirt/sweater which is reversible and comprised of two different sides, each having fabric of different color, pattern and/or texture. The sleeves are slightly tapered and extended in length over the conventional sleeve lengths so that when simply rolled up they can automatically serve as cuffs (18). The rolled-up cuff feature, while providing extra aesthetic contrast in color, pattern and/or texture, also eliminates the need for making and using separate cuffs (12) which in any case render the extra thick sleeves (because they are two layered) unattractive by necessitating drastic tapering to accommodate them. The shirts/sweaters can further be cut in such a fashion, e.g., in the collar (22) and bottom rim (20) as to simply yet elegantly provide contrast in color, pattern and/or texture in a stylish, comfortable form.

2 Claims, 6 Drawing Sheets

REVERSIBLE TWO-TONED AND/OR TWO-TEXTURED SHIRT/SWEATER WITH EXTENDED SLEEVES

This application is a continuation of application Ser. No. 08/052,714, filed Apr. 26, 1993 now abandoned.

BACKGROUND

1. Field of Invention

This invention relates to shirts and sweaters, specifically reversible ones.

2. Description of Prior Art

Many types of shirts and sweaters have been created, including "sweatshirt" style ones. These generally consist of two sleeves and a bodice, with all the seams folded down and sewn, hence visible when reversed. (In other words, there is an inside out side.) Reversible versions of the above mentioned items have also been created which not only eliminate such exposed seams but also provide extra warmth and diversity over their standard, non-reversible counterparts. In most cases, these reversible clothing have a fabric of different pattern and/or color for each side, thereby taking advantage of the two-in-one feature, that is, of having two different shirts/sweaters in one. However, because of the use of conventional cuffs and ribbed rims (see FIG. 1) imposing more drastic tapering at the sleeve ends, bottom rims and collars, these garments have the disadvantages of being tight fitting, awkward, and bulky in appearance, as well as being complicated to produce since they require additional separate cutting, fitting, and attachment. No design for reversible shirts, sweaters, and/or sweatshirts heretofore known has effectively combined the elements to create a reversible top which is extremely functional, comfortable and yet stylish.

OBJECTS AND ADVANTAGES

Accordingly, beside the above mentioned objects and advantages of reversible clothing such as having no dull underside of fabric exposed, double layered insulation for added warmth, and two different sides for added usefulness (handy for quick changes, etc.), more objects and advantages of my invention are:

(a) to provide a reversible top which is warm and comfortable without having the bulky, padded look typical of standardly designed reversible shirts and sweaters;

(b) to provide a reversible top with extra contrast for added aesthetic effect;

(c) to provide a reversible top with extra texture and color contrast for added versatility in mixing and matching possibilities;

(d) to provide a reversible top whose production is extremely convenient, rapid and economical;

(e) to provide a reversible top which is extremely simple yet stylish.

Further objects and advantages will become apparent from a consideration of the ensuing description and drawings.

DRAWING FIGURES

Reference Numerals In Drawings

10: conventional collar

12: conventional cuffs

14: conventional bottom rim

16: stitching for closure and contrasting collar

18: extended sleeve length

20: contrasting bottom rim

22: lower front collars

DESCRIPTION

FIGS. 1 to 9

The construction of a typical embodiment of the reversible top of my design is illustrated in FIGS. 2 to 9. As shown in FIGS. 8A and 8B, in the preferred embodiment, each side of the garment is made of cotton of a different color and texture from the other (e.g., smooth vs. ribbed). The fabric of each side is similar not only in content, but also in weight and thickness, such that when combined together they comprise a shirt/sweater providing warmth equivalent to that of a sweater/sweatshirt. The cost for using twice the amount of thinner material is equal to or less than that for the thicker material conventionally used (such as fleece in the case of sweatshirts) while additionally providing two different shirts/sweaters rather than just the one. (For the purpose of facilitating the description, the shorter base pieces are referred to as black, and the longer contrasting pieces as red.)

Figure 5A:
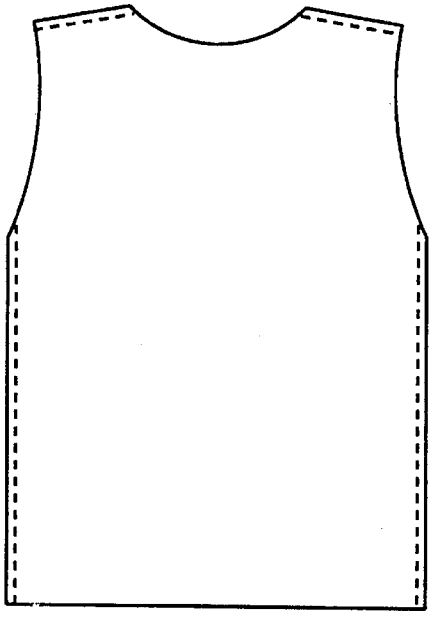
FIGS. 5A and 5B show the bodice pieces sewn together for the shorter and longer shirt/sweater, respectively.
Figure 5B:
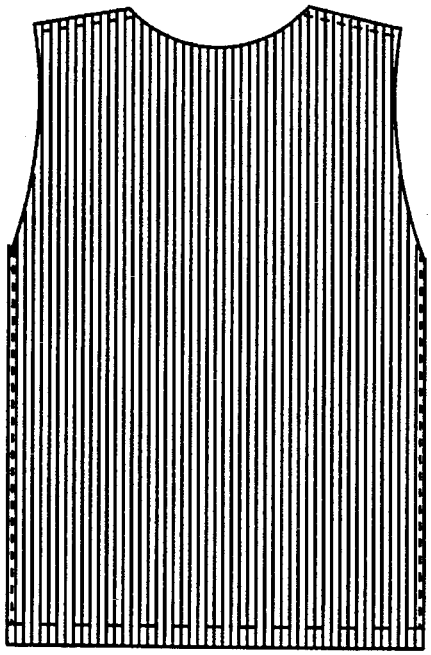
Figure 6A:
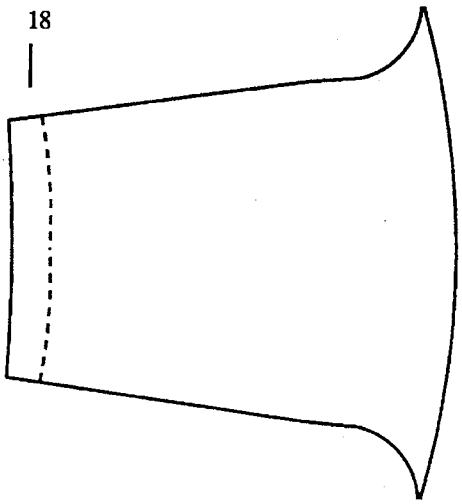
FIGS. 6A to 6D show the four sleeve pieces all cut to an extended length.
Figure 6B:
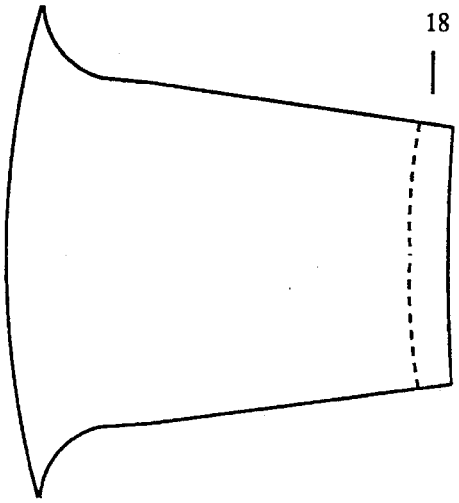
Figure 6C:
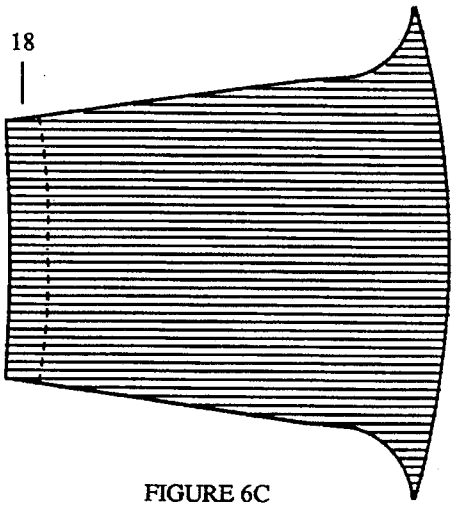
Figure 6D:
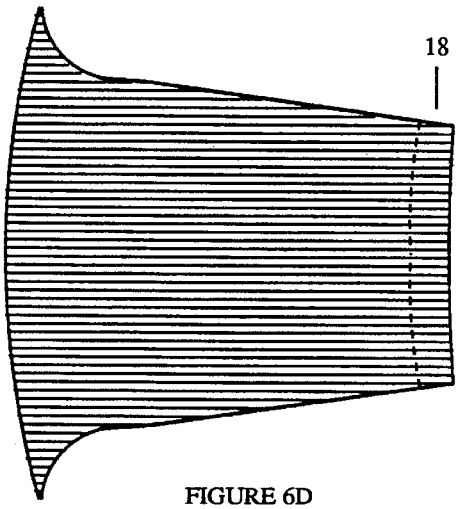
Figure 7A:
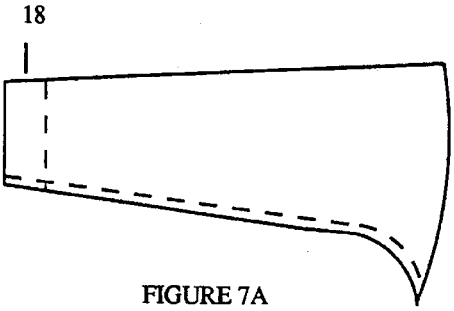
FIGS. 7A to 7D show each of the four sleeve pieces folded in half lengthwise and sewn together.
Figure 7B:
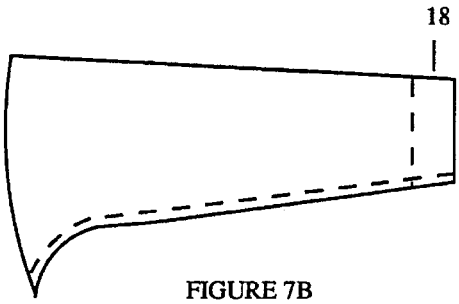
Figure 7C:
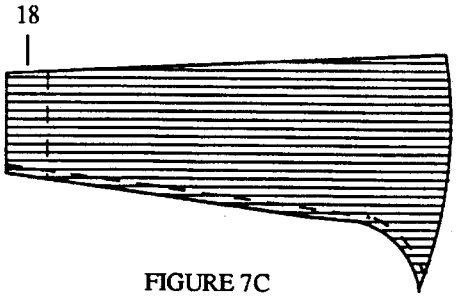
Figure 7D:
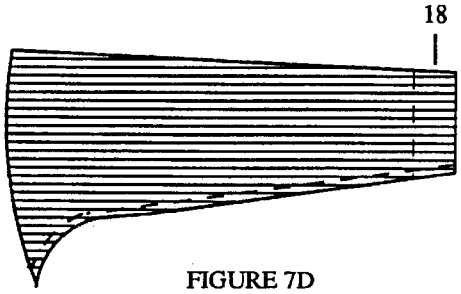

As shown in FIGS. 3A to 4B, four pieces for the body are cut identically, except that the bottoms 20 of the contrasting red pieces (FIGS. 4A and 4B) extend a few inches longer than the black ones, and the collar portions 22 of both front pieces are slightly lower. (This is to allow for the contrasting feature as will be seen later.) Each piece of the same color is sewn together at the seams (FIGS. 5A and 5B).

Figure 8A:
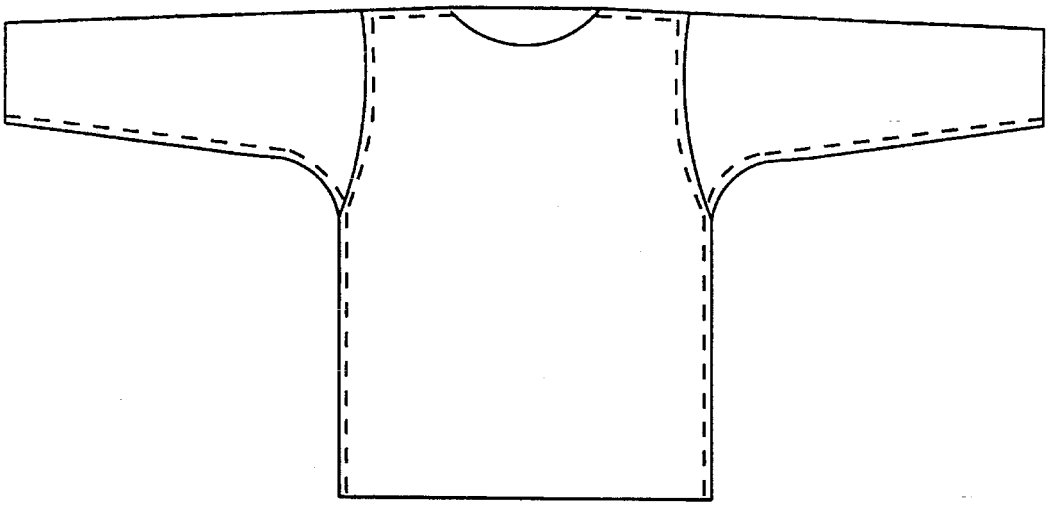
FIGS. 8A and 8B show the sleeves sewn to their respective matching bodice pieces.
Figure 8B:
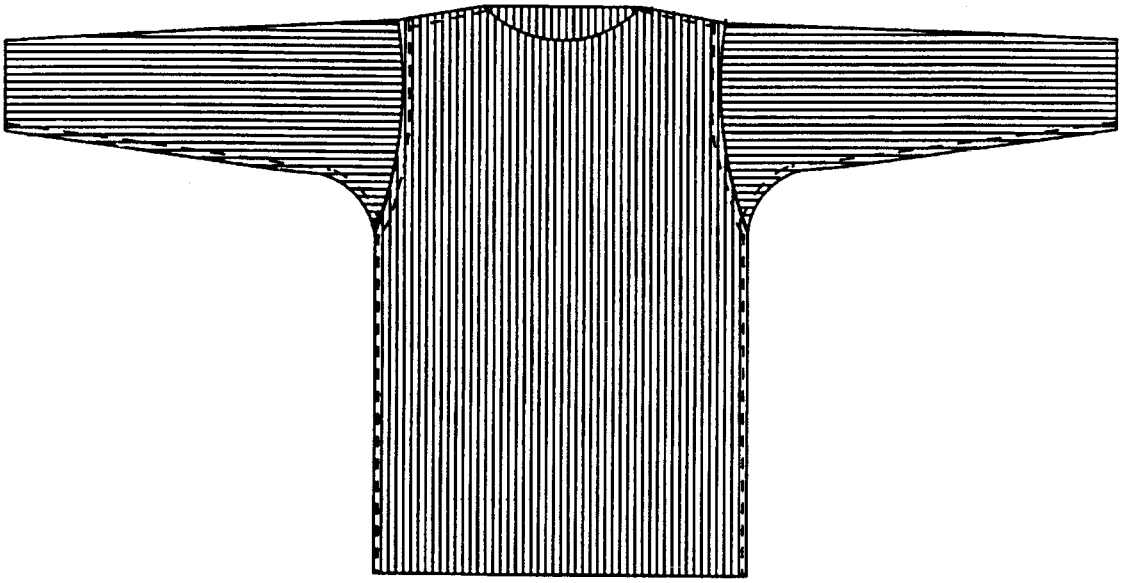

The four sleeve ends 18 extend beyond the wrists at least one to two inches (FIGS. 6A to 7D). Each sleeve is folded in half lengthwise and sewn at the seams (FIGS. 7A to 7D). The sleeves are then sewn to the bodice pieces of matching color (FIGS. 8A and 8B).

Once the sleeves are all attached to their appropriate bodice pieces, resulting in two pull-overs of different color (FIGS. 8A and 8B), these said pull-overs are placed one inside the other with the inside out side (i.e., the sides with the seams exposed) showing. The two pull-overs are then sewn together at the sleeve ends (FIG. 9).

Figure 9:
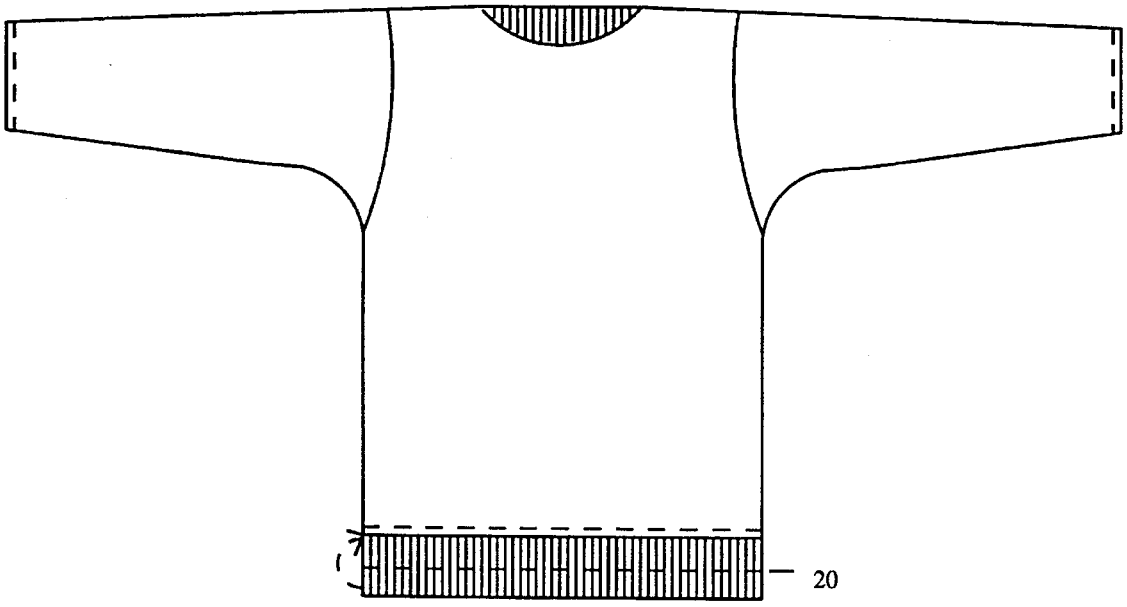
FIG. 9 shows the longer shirt/sweater placed inside the shorter one, the sleeve ends of both shirts/sweaters sewn together (both shirts/sweaters are turned inside out), and the rim of the longer ribbed shirt/sweater folded up and sewn to the rim of the shorter one.

The bottom extended rim 20 of the contrasting red pull-over is folded up and sewn to the bottom rim of the black pull-over (FIG. 9). This serves to form the contrasting bottom rim without the need for cutting and attaching a separate piece 14 (FIG. 1) for the same purpose. (This advantage also applies to the extra long sleeve ends which serve to replace cuffs 12 of FIG. 1).

Figure 1:
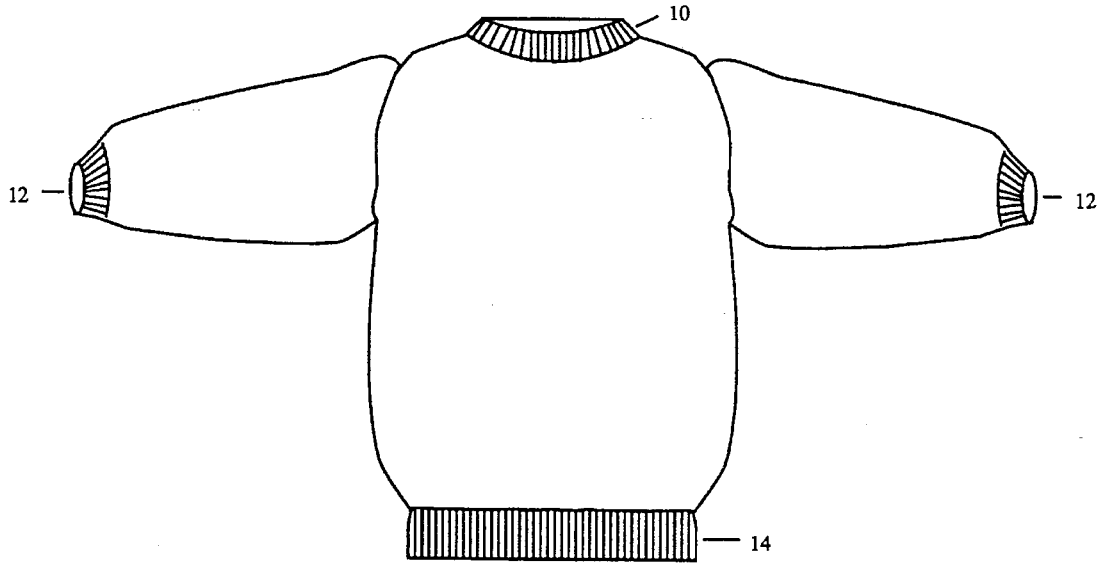
FIG. 1 shows a typical conventionally shaped reversible shirt/sweater with ribbed cuffs, collar and bottom.
Figure 2:
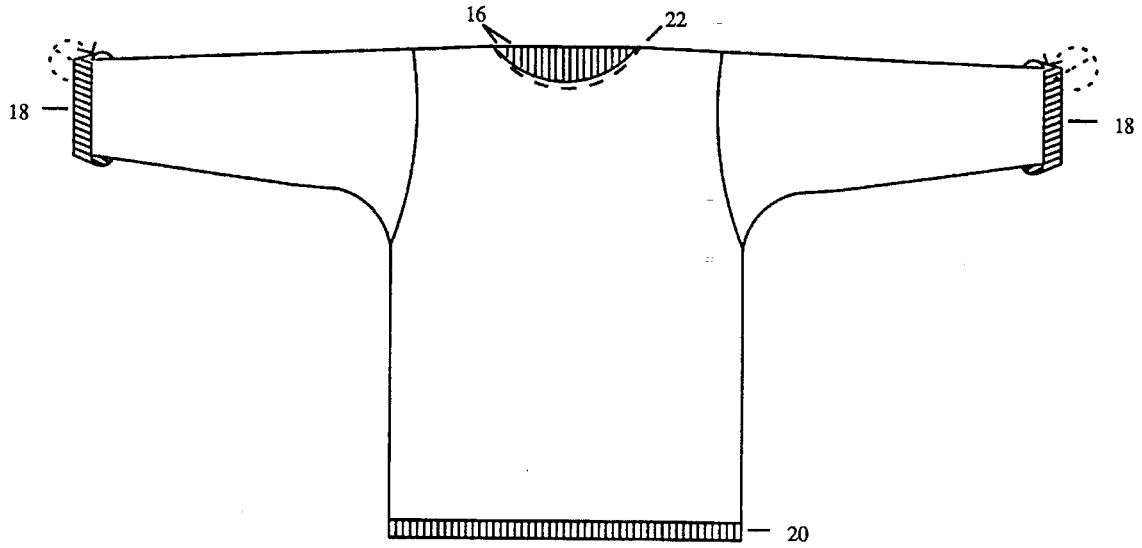
FIG. 2 shows a finished reversible shirt/sweater of this invention (comfortable stylish form; contrasting cuffs, collar and bottom rim).
Figure 3A:
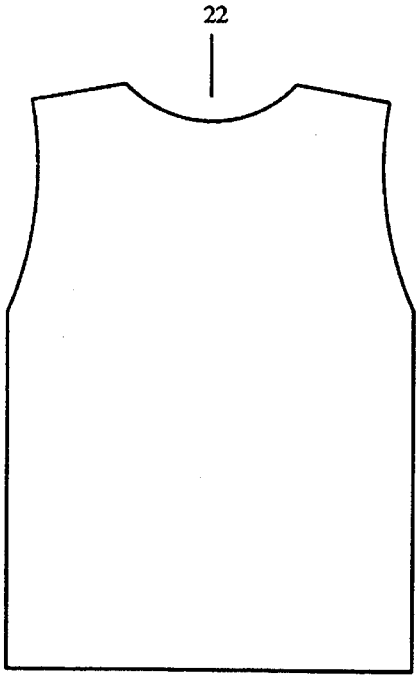
FIGS. 3A and 3B show the two pieces comprising the bodice of the shorter, smooth shirt/sweater.
Figure 4A:
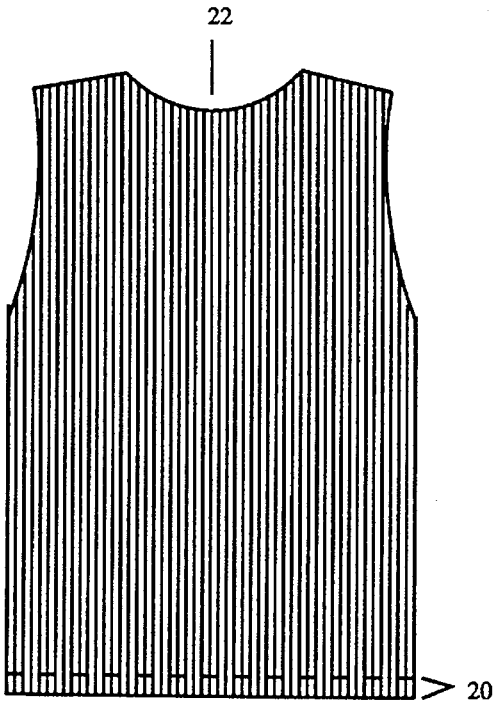
FIGS. 4A and 4B show the two pieces comprising the bodice of the longer, contrasting shirt/sweater.
Figure 3B:
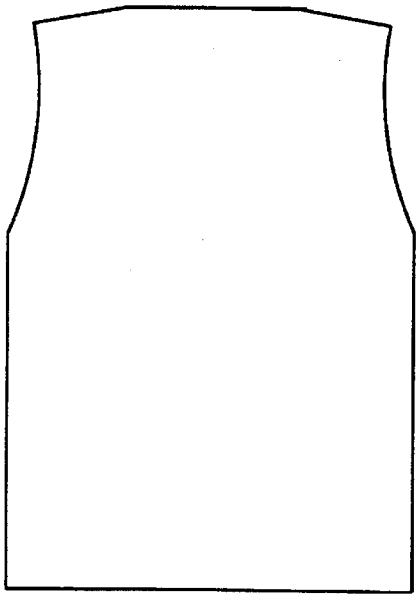
Figure 4B:
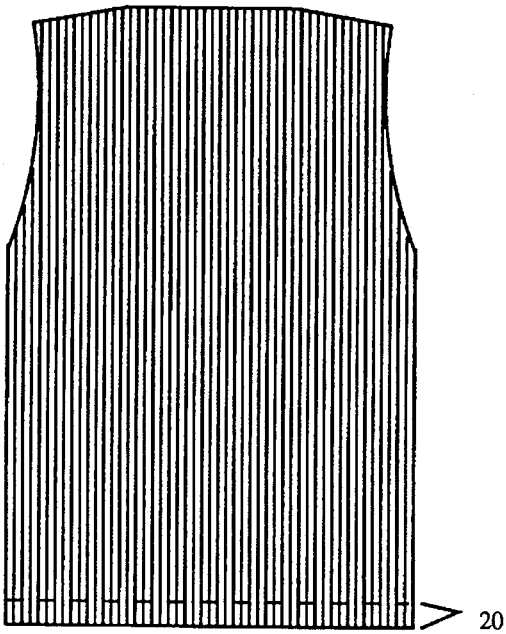

Using the remaining open hole at the collar, the pull-overs are inverted (i.e., turned inside out) so that no open seams can been seen. Finally, the collar rims are turned down and sewn together closing off the entire garment (FIG. 2). Note that the stitching 16 of the two collar pieces together in such a fashion—whereby the two colors are complementing each other—further adds a nice boarder to the garment and eliminates the need for the separate collar piece 10 (FIG. 1). FIG. 2 shows the sleeves rolled up to form the contrasting cuffs 18.

Operation—FIG. 2

The manner of using the reversible top of this invention is identical to that for reversible pull-overs in present use. Namely, one simply pulls the garment over one's head and wears it. When the use of the other side of the reversible garment is desired, one need simply to reverse the garment. In both cases (i.e., when using either the black or red side), to further enhance the said garment, one need merely to roll up the sleeve ends to form cuffs 18 of contrasting color and/or texture.

Accordingly, the reader will see that the reversible top of this invention can be used easily and conveniently, without the cumbersome, constricting feeling imposed by reversibles with conventional collars and cuffs. Furthermore, the functionality of the reversible garment is substantially enhanced by the design which simply yet maximally combines the advantages of reversible tops (e.g., two-in-one feature, extra warmth, etc.) in a comfortable, stylish form. The rolled-up cuff feature, while providing aesthetic enhancement, also eliminates the need for making separate cuffs. Thus even in its simplest form, this design provides a considerable improvement in the versatility, diversity and therefore usefulness of the reversible garment. Essentially, the top of this invention offers the comfort and warmth of a sweatshirt, the style of a sweater, and the full advantages of being reversible.

Although the above description contains many specificities, these should not be construed as limiting the scope of the invention but as merely providing illustrations of some of the presently preferred embodiments of this invention. For example, the lengths of the sleeves do not necessarily have to correspond to long sleeves but can also apply to various sleeve lengths such as cap, short, three-quarter, etc. Furthermore, a hood, collar, zipper and/or buttons can be added if desired.

Thus the scope of the invention should be determined by the appended claims and their legal equivalents, rather than by the examples given.

I claim:

1. A reversible garment, comprising:

a first component garment fabricated of a material of a prescribed appearance, said first component garment having a body consisting of one front panel and one back panel, said body having a neck opening and a waist opening, said body having sleeves attached thereto and said sleeves having wrist openings;

a similar second component garment fabricated of a material similar in fabric content and weight to that of said first component garment, said material being different in prescribed appearance from that of said first component garment, said second component garment having a body consisting of one front panel and one back panel, said body having a neck opening and a waist opening, said body having sleeves attached thereto and said sleeves having wrist openings;

said first and second component garments being joined only along their neck openings, waist openings and each of their respective wrist openings, and said first and second component garments directly confronting each other over substantially all of their confronting surfaces without the interposition of other garment components.

2. A reversible garment as claimed in claim 1 in which the edge of at least one of said openings of said first component garment is joined to said second component garment at a location remote from the edge of the corresponding opening of said second component garment.

* * * * *